US005154813A

United States Patent [19]

Dill

[11] Patent Number: 5,154,813

[45] Date of Patent: Oct. 13, 1992

[54] PROTECTIVE COATING OF STUB ENDS IN ANODE ASSEMBLIES

[76] Inventor: Raymond J. Dill, 1910 Erskine Dr., Florence, Ala. 35630

[21] Appl. No.: 712,511

[22] Filed: Jun. 10, 1991

[51] Int. Cl.[5] ..... C25C 3/12; C25C 3/10

[52] U.S. Cl. ..... 204/286; 204/294

[58] Field of Search ..... 204/67, 294, 286, 243 R-247

[56] References Cited

U.S. PATENT DOCUMENTS

| | | | |
|---|---|---|---|
| 3,536,460 | 10/1970 | Voelker | 204/286 |
| 4,354,918 | 10/1982 | Boxall et al. | 204/286 |
| 4,787,965 | 11/1988 | Audras et al. | 204/294 X |
| 4,946,502 | 8/1990 | Audras et al. | 204/286 X |

FOREIGN PATENT DOCUMENTS

| | | | |
|---|---|---|---|
| 356311 | 1/1973 | U.S.S.R. | 204/286 |

OTHER PUBLICATIONS

E. J. Westerman et al., "Puncher Tip Alloys for Aluminum Reduction Cells", Journal of Metals, Nov. 1984, pp. 29-32.

*Primary Examiner*—Donald R. Valentine

*Attorney, Agent, or Firm*—Phillips & Beumer

[57] ABSTRACT

The operating lifetime of mild steel stub ends in anode electrode assemblies for aluminum reduction cells is increased by providing a coating of stainless steel or other corrosion-resistant alloy on the stub end extending upward from its juncture with a carbon block anode in which the stub end is embedded. This prevents corrosion and resulting necking down of the stub, which would otherwise occur as a result of exposure of the stub end to fluorine or fluorine containing gases as well as solid particles. The coating may be applied by welding or metalizing procedures.

9 Claims, 2 Drawing Sheets

PROTECTIVE COATING OF STUB ENDS IN ANODE ASSEMBLIES

FIELD OF THE INVENTION

This invention relates to anode electrode assemblies of aluminum reduction cells.

BACKGROUND OF THE INVENTION

Production of aluminum metal by reduction of aluminum oxide ore is typically carried out in large cells using a molten cryolite electrolyte and carbon block anodes through which massive amounts of electric current are introduced. The carbon blocks form one component of an anode electrode assembly which normally includes a mild steel yoke having a pair of stub ends embedded in the block and coupled to an aluminum stem extending downward from an overhead support. Large numbers of these assemblies may be provided in a single reduction cell.

In operation of such cells, the electrolyte is maintained at a high temperature such as 970° C. and this, in combination with the corrosive nature of the electrolyte, presents a severe environment to the electrode assembly. The carbon block electrode becomes corroded away and must be replaced or refurbished at regular intervals. A large aluminum production facility's electrode refurbishment operations are normally carried out on a continuous basis in a "rodding room" adjacent to the production cell.

Stub ends of the electrode assembly also become corroded away adjacent to their juncture with the carbon block electrode. The stub ends at that location are exposed to fluorine and other fluorine-containing gas or liquid species produced in the molten electrolyte, $Na_3AlF_6$, as well as to solid particles of aluminum oxide introduced onto the carbon blocks from above. Stub ends are relatively large in size, for example, six inches in diameter and in practice are made of mild steel for reasons of cost. The operating lifetime of stub ends is limited by their becoming necked-down adjacent to their juncture with the electrode. This reduces the amount of current delivered to the carbon electrode. Prevention of corrosion at this critical location would substantially prolong the operating lifetime of the stubs as well as the assembly as a whole, except for the carbon blocks which are consumed as a part of the normal process.

SUMMARY OF THE INVENTION

The present invention is directed to prolonging the operating lifetime of mild steel stubs of anode electrode assemblies for aluminum production cells by coating the exposed stub ends adjacent to their juncture with carbon electrode blocks with a high-temperature corrosion resistant metal or alloy such as stainless steel. This provides a protective band on the stub ends at their most vulnerable area and prevents the necking down which would otherwise occur. The coating may be readily applied by welding techniques using a welding wire made of the desired corrosion resistant metal or by a metalizing process. Stub ends coated in this manner may be used over an extended period and do not require frequent replacement or refurbishment.

It is, therefore, an object of this invention to provide protection of exposed mild steel stub ends from being corroded by fluorine-containing gases released by molten cryolite in an aluminum reduction cell.

Another object is to provide an electrode assembly stub end having a long operating lifetime.

Other objects and advantages of the invention will be apparent from the following detailed description and the appended claims.

DESCRIPTION OF THE PREFERRED EMBODIMENT

Figure 1:
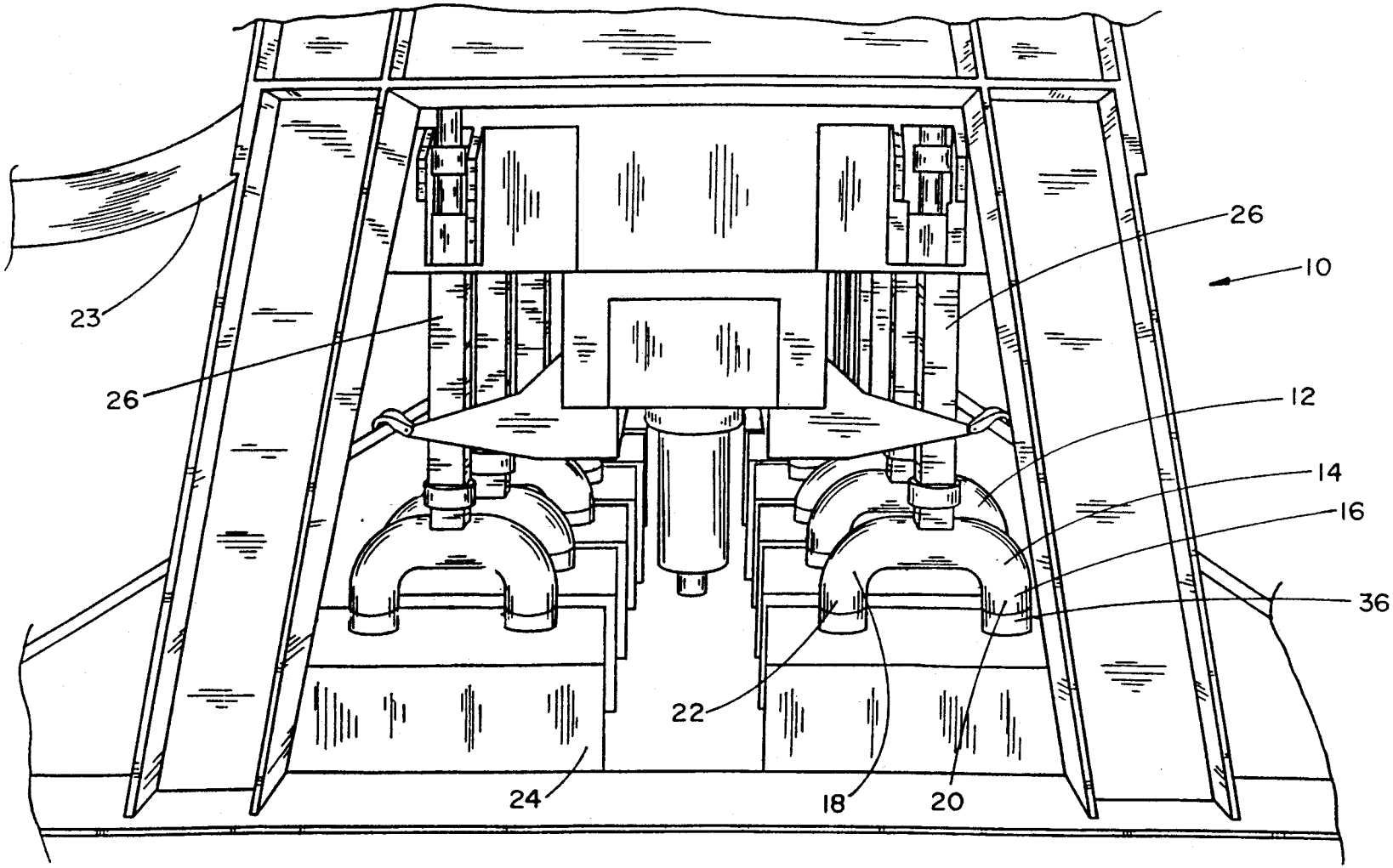
FIG. 1 is a pictorial view of an aluminum ore reduction cell utilizing the stub end coating of the present invention.
Figure 2:
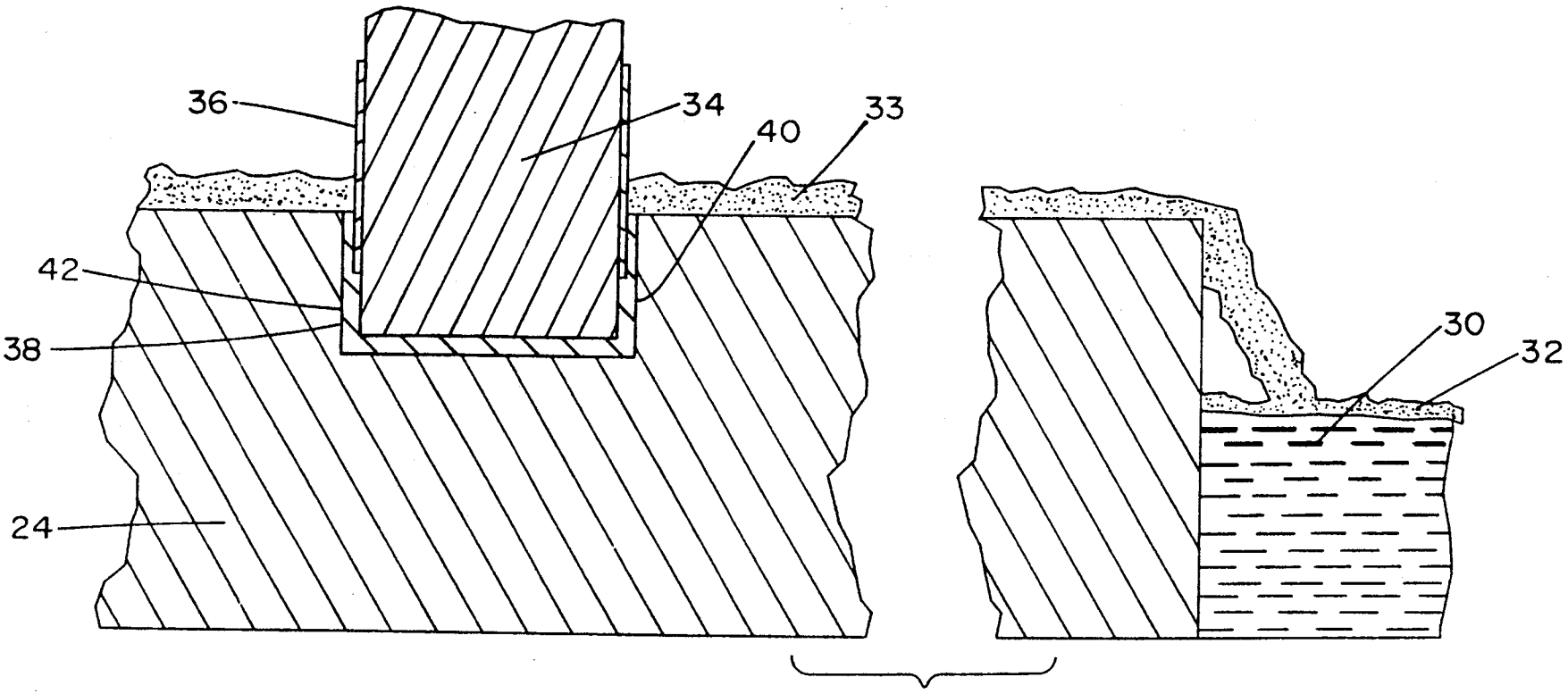
FIG. 2 is a sectional view of a coated stub embedded in a carbon block anode partially submerged in molten electrolyte.

Referring to FIG. 1 of the drawings, there is shown an aluminum reduction cell 10 having a plurality of electrode assemblies 12. Each electrode assembly includes a mild steel yoke 14 with a pair of stubs 16, 18 extending downward and having their ends 20, 22 embedded in a carbon block anode 24. The yoke at its upper end is joined to an aluminum stem 26 supported from above and coupled to electrical conductors 23. As shown in FIG. 2, the carbon blocks are partially submerged in a molten cryolite electrolyte 30, which has a crust 32 of solid particles floating on top. Aluminum oxide ore 33 is introduced into the electrolyte by cascading downward from a source not shown onto the tops of the blocks and falling over the edges of the blocks. Areas 34 of the stub ends adjacent to their juncture with the carbon block have a coating 36 of stainless steel or other corrosion-resistant alloy applied thereto.

The stub ends are embedded in holes 38 in the carbon block and are secured in place by thimble 40 comprising a layer of cast iron cast into a space 42 between the wall of the hole and the stub end. Coating 36 preferably extends a short distance such as ¼ inch below the surface of the block to form an overlapping seal and prevent corrosion from occurring at the joint or connection between the cast iron and the coating. The coating is provided for a distance such as to obtain effective protection, with a length of about four to six inches being preferred for typical cell designs. Coating 36 may comprise a corrosion-resistant metal or alloy such as a stainless steel, nickel-based alloy or other alloy containing substantially the amounts of constituents such as chromium that impart the corrosion resistance. Stainless steels are preferred for reasons of costs and effectiveness, in particular, austenitic stainless steel designated by the following numbers may be used: 317, 317L, 302, 316, 310, 304, and 347. Ferritic stainless such as Nos. 430 and 446 and martensitic stainless steels may also be used. Examples of other types of alloys which may be used include Hasteloy TM and Inconel TM.

The coating may be applied to the stub surface by means of welding procedures using the coating metal in the form of a wire and melting it with a shielded arc-type welding torch. A coating thickness of approximately ⅛ inch may be applied in a single pass by this means. It is preferred to use two passes to obtain a final coating thickness of approximately ¼ inch. Metalizing processes wherein the metal coating is formed into minute droplets and sprayed onto the stub surface may also be used.

The invention as illustrated above with respect to an aluminum reduction cell has multiple anode electrode assemblies, each including a bifurcated yoke with a pair of stubs. However, the invention is not to be understood as limited to a specific cell design as it may be applied to anode assemblies having a single stub or more than two stubs. Other features of the anode assembly and cell designs may also be varied without departing from the scope of the invention, which is limited only as indicated by the appended claims.

I claim:

1. In an anode assembly for an aluminum reduction cell having at least one mild steel electrically conductive stub embedded in and extending upward from a carbon block anode disposed in a molten cryolite electrolyte, the improvement comprising:

a corrosion resistant metal or alloy coating covering said stub over an area extending upward from said carbon block a distance of approximately 4 to 6 inches.

2. The improvement as defined in claim 1 wherein said coating is comprised of stainless steel.

3. The improvement as defined in claim 2 wherein said coating comprises an austenitic stainless steel.

4. The improvement as defined in claim 3 wherein stainless steel is a 317, 317L, 302, 316, 310, 304, or 347 stainless steel.

5. The improvement as defined in claim 2 wherein said coating is applied by melting of stainless steel wire with a welding torch and allowing the wire to flow over the surface.

6. The improvement as defined in claim 2 wherein said coating is applied by metalizing.

7. The improvement as defined in claim 2 wherein said coating has a thickness of $\frac{1}{8}$ to $\frac{1}{4}$ inch.

8. The improvement as defined in claim 1 wherein said anode assembly has a pair of stubs.

9. In an anode assembly for an aluminum reduction cell having at least one mild steel electrically conductive stub embedded in and extending upward from a carbon block anode disposed in a molten cryolite electrolyte, said stub having an end embedded in a layer of cast iron disposed between the stub end and walls of a hole in which the stub is embedded, the improvement comprising:

a corrosion resistant metal or alloy coating covering said stub over an area extending slightly into said cast iron layer and upward from said carbon block a distance such to protect said stub from corrosion in operation of said cell.

* * * * *